US009004625B2

(12) United States Patent
Yamasaki

(10) Patent No.: US 9,004,625 B2
(45) Date of Patent: Apr. 14, 2015

(54) NAIL PRINT APPARATUS AND PRINT CONTROL METHOD THEREOF FOR FITTING FIRST DESIGN AND SECOND DESIGN THAT IS BACKGROUND OF FIRST DESIGN TO NAIL

(71) Applicant: Casio Computer Co., Ltd., Shibuya-ku, Tokyo (JP)

(72) Inventor: Shuichi Yamasaki, Fussa (JP)

(73) Assignee: Casio Computer Co., Ltd., Tokyo (JP)

( * ) Notice: Subject to any disclaimer, the term of this patent is extended or adjusted under 35 U.S.C. 154(b) by 0 days.

(21) Appl. No.: 14/014,144

(22) Filed: Aug. 29, 2013

(65) Prior Publication Data

US 2014/0063084 A1 Mar. 6, 2014

(30) Foreign Application Priority Data

Aug. 31, 2012 (JP) ..... 2012-190904

(51) Int. Cl.

| | |
|---|---|
| ***B41J 3/00*** | (2006.01) |
| ***B41J 2/01*** | (2006.01) |
| ***A45D 29/00*** | (2006.01) |
| ***B41J 3/407*** | (2006.01) |

(52) U.S. Cl.

CPC ..... *B41J 3/4073* (2013.01); *B41J 3/407* (2013.01)

(58) Field of Classification Search

CPC ..... B41J 3/407; B41J 3/4073; B41J 11/008; A45D 29/00; A45D 2029/005

USPC ..... 347/2, 3, 5, 101, 105; 132/73, 73.5

See application file for complete search history.

(56) References Cited

U.S. PATENT DOCUMENTS

| | | | | |
|---|---|---|---|---|
| 2005/0174367 | A1 | 8/2005 | Kondo et al. | |
| 2012/0103210 | A1 | 5/2012 | Hashimoto | |
| 2012/0287183 | A1* | 11/2012 | Bitoh | 347/5 |

FOREIGN PATENT DOCUMENTS

| | | | |
|---|---|---|---|
| CN | 1498564 | A | 5/2004 |
| CN | 102555525 | A | 7/2012 |
| JP | 2004-154944 | A | 6/2004 |

OTHER PUBLICATIONS

Chinese Office Action dated Dec. 16, 2014, issued in counterpart Chinese Application No. 201310388421.1.

* cited by examiner

*Primary Examiner* — Jannelle M Lebron

(74) *Attorney, Agent, or Firm* — Holtz, Holtz, Goodman & Chick PC

(57) ABSTRACT

A nail print apparatus, including: a print head which performs printing on a nail region on the basis of image data including a first design and a second design that is a background of the first design; and an image data processing unit which has a second image data processing unit that processes the image data so that the second design covers an entire nail region.

12 Claims, 15 Drawing Sheets

FIG. 7

512

FITTING TABLE STORAGE UNIT

| DESIGN ACCESS INFORMATION | DESIGN MODE | CONTENTS | REPEAT WIDTH |
|---|---|---|---|
| DESIGN Da | MODE A | INCLUDE PICTURE DESIGN IN NAIL AND EXTEND BACKGROUND DESIGN | 8 PIXELS |
| DESIGN Db | MODE B | INCLUDE NAIL REGION IN DESIGN IMAGE | — |
| DESIGN Dc | MODE C | INCLUDE PICTURE DESIGN IN NAIL AND INCLUDE NAIL REGION IN BACKGROUND DESIGN | — |
| DESIGN Dd | MODE A | INCLUDE PICTURE DESIGN IN NAIL AND EXTEND BACKGROUND DESIGN | 8 PIXELS |
| . . . | . . . | . . . | . . . |
| DESIGN Dn | MODE B | INCLUDE NAIL REGION IN DESIGN IMAGE | — |

NAIL PRINT APPARATUS AND PRINT CONTROL METHOD THEREOF FOR FITTING FIRST DESIGN AND SECOND DESIGN THAT IS BACKGROUND OF FIRST DESIGN TO NAIL

BACKGROUND OF THE INVENTION

1. Field of the Invention

The present invention relates to a nail print apparatus and a print control method thereof for fitting a first design and a second design that is the background of the first design to a nail.

2. Description of Related Art

Conventionally, there are known nail print apparatuses to print (perform nail printing) desired design images on fingernails of people.

By using such apparatuses, nail printing can be enjoyed easily without visiting nail salons and such like.

When printing a design image on a nail by a nail print apparatus, the design image needs to be fitted to a nail of a user in size and shape.

With respect to this, for example, Japanese Patent Application Laid Open Publication No. 2004-154944 suggests a technique in which approximate size of the nail is taken into the apparatus, a nail art pattern (design image) is synthesized with an approximate outline of the nail, and thereby the design image is fitted to the nail of the user in size and shape.

However, there are nails of various shapes such as a nail long in extending direction (vertical direction) and a nail long in width direction (horizontal direction). Moreover, in most cases, the nail's length in width direction (horizontal direction) which is orthogonal to the extending direction (vertical direction) varies depending on a position in the extending direction (vertical direction) of the nail. Thus, when the design image is merely synthesized with the approximate outline of the nail, it is difficult to completely fit the design image into the user's nail and there can be an unprinted area and running off the edge.

Thus, in order to prevent the unprinted area and running off the edge of the design image, Japanese Patent Application Laid Open Publication No. 2004-154944 discloses adjusting the size, aspect ratio and position of a pattern to be printed so as to fit a nail by a person to be printed (user).

However, fine adjustment of the size, aspect ratio, position and such like of the design to be printed by a user himself/herself so as to fit the nail requires considerable time and trouble. Thus, nail printing cannot be enjoyed casually if nail printing suitable for the user's nail cannot be performed without such preparation.

Furthermore, for example, in a case where the design image includes a first design such as a one-point picture pattern and a second design which is an overall pattern where a small design is scattered throughout the design image and which is the background of the first design, if the second design is reduced and adjusted to the size and shape of the nail, the picture loses arrangement balance or gets distorted. Also, if the image data is reduced and adjusted to fit to the shorter length among the vertical and horizontal lengths of the nail so as to include the whole picture in the nail, the background is also reduced together and becomes too short in the direction of the longer length among the vertical and horizontal lengths of the nail, generating an area where the background image is not printed.

That is, for example, when a design image formed of a horizontally long first design (for example, a picture of a pencil lying sideways) and a horizontally long second design is to be adjusted (fitted) into a vertically long nail, if the design image is fitted so as to cover the whole vertical length with the second design, the first design becomes so large as to run off the edge of the nail or becomes a distorted first design with an altered aspect ratio which is enlarged in the vertical direction (a picture of a distorted pencil which is thick in vertical direction). If the design image is fitted so that the first design fits to the length in width direction of the nail, the first design does not run off the edge of the nail; however, the second design becomes smaller than the nail, generating an area (unprinted area) in a nail in which the design image is not printed.

In order to prevent such inconvenience, it is necessary to perform very troublesome processing such as preparing a large design image which can fit to any kind of nail and fitting the design image to each nail manually by a user. Thus, the nail printing cannot be performed easily and rapidly.

The present invention was made in consideration of above problems and an object of the present invention is to provide a nail print apparatus and a print control method thereof for fitting each of a first design and a second design that is the background of the first design to a nail when printing a design image on a nail.

SUMMARY OF THE INVENTION

According to one aspect of the present invention, there is provided a nail print apparatus, including: a print head which performs printing on a nail region on the basis of image data including a first design and a second design that is a background of the first design; and an image data processing unit which has a second image data processing unit that processes the image data so that the second design covers an entire nail region.

According to another aspect of the present invention, there is provided a print control method of a nail print apparatus, including processing image data by an image data processing unit which has a second image data processing unit that processes the image data so that a second design covers an entire nail region in a case where printing is performed on the nail region by a print head on the basis of the image data including a first design and the second design that is a background of the first design.

BRIEF DESCRIPTION OF THE DRAWINGS

The above and other objects, advantages and features of the present invention will become more fully understood from the detailed description given hereinafter and the appended drawings which are given by way of illustration only, and thus are not intended as a definition of the limits of the present invention, and wherein:

FIG. 7 is a diagram showing a data configuration example of a fitting table storage unit in the embodiment;

DETAILED DESCRIPTION OF THE PREFERRED EMBODIMENT

With reference to FIGS. 1 to 13, an embodiment of the nail print apparatus according to the present invention will be described.

Figure 1:
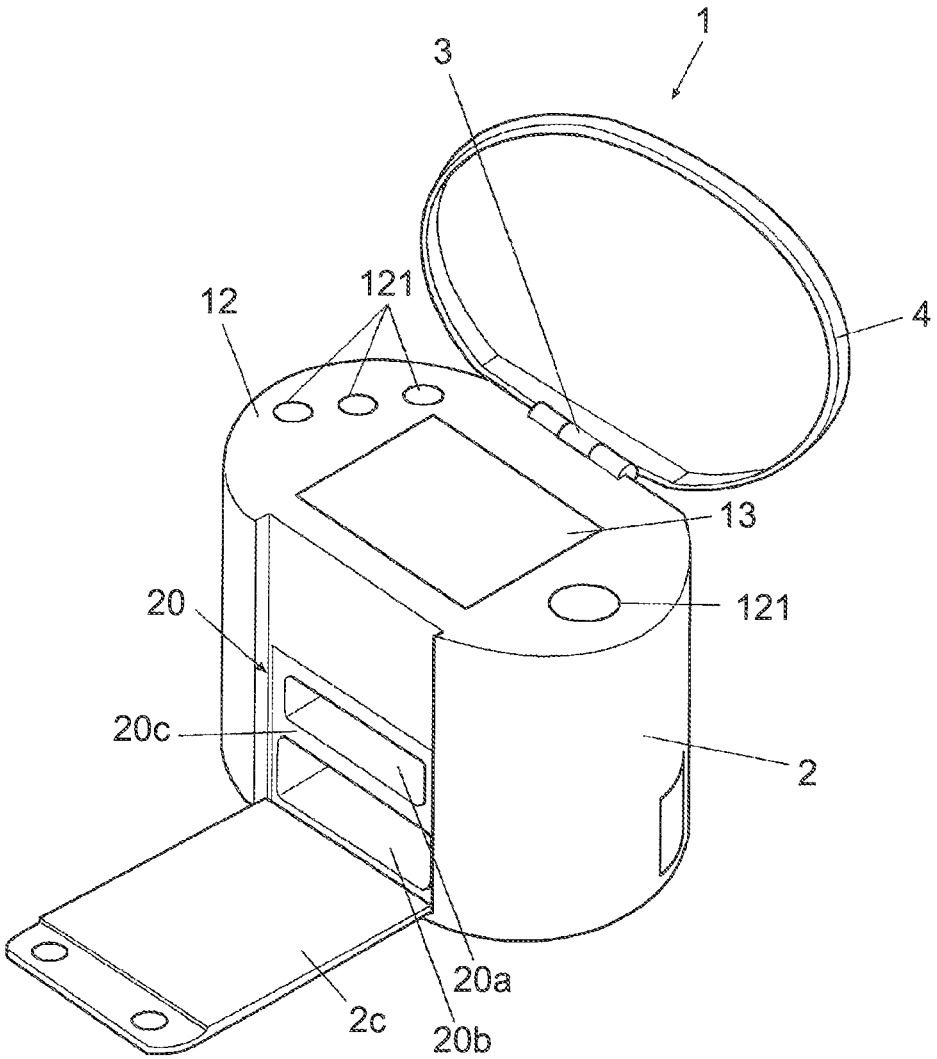
FIG. 1 is a schematic diagram conceptually showing an embodiment of a nail print apparatus of the present invention, which shows a state where a cover is open.
Figure 2:
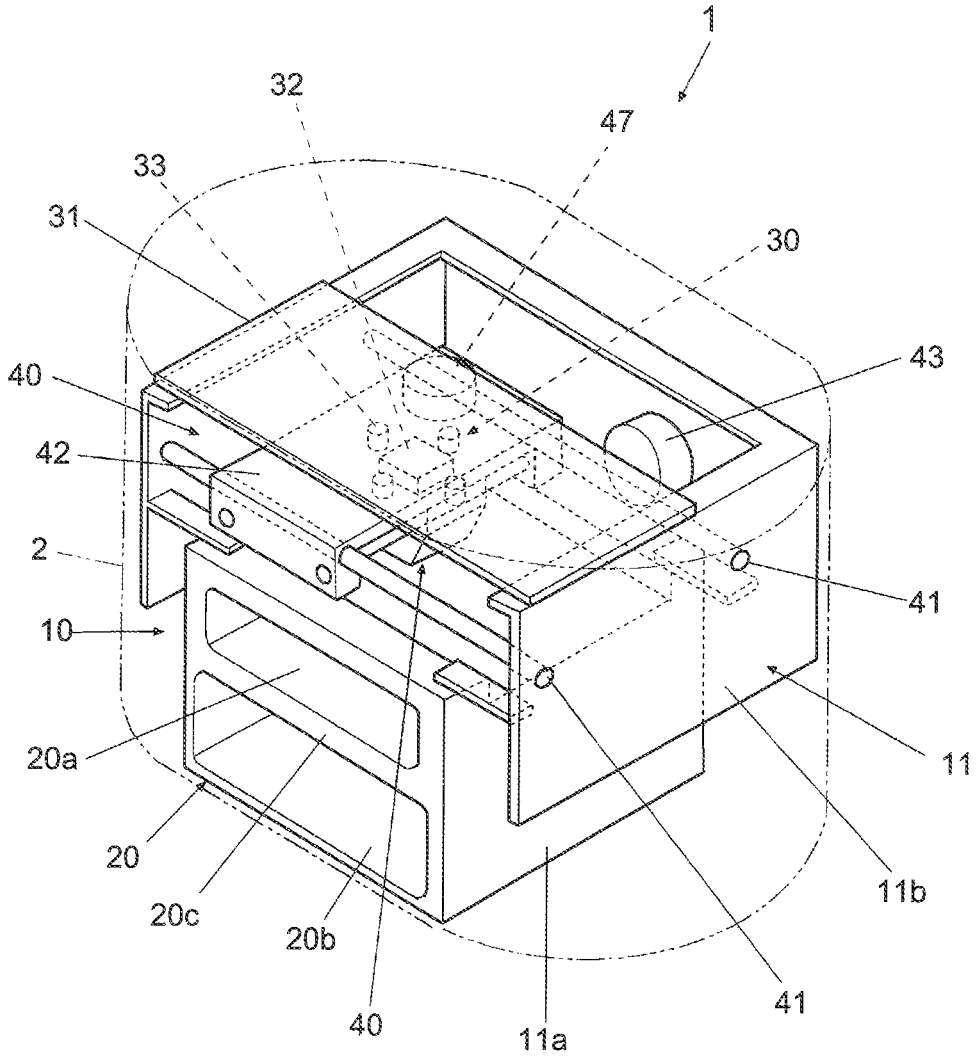
FIG. 2 is a schematic diagram conceptually showing an apparatus main body of the nail print apparatus of FIG. 1.

FIG. 1 is a schematic view showing the outer appearance of the nail print apparatus in the embodiment, and FIG. 2 is a schematic view showing an inner configuration of the nail print apparatus.

As shown in FIG. 1, the nail print apparatus 1 includes a case main body 2 and a cover 4. The case main body 2 and the cover 4 are connected to each other via a hinge 3 provided at an upper rear end portion of the case main body 2.

The case main body 2 is formed in an oval shape in a plan view. An opening/closing plate 2*a* is provided at the front side of the case main body 2 so as to be able to flip up and down. The opening/closing plate 2*a* is joined to the case main body 2 via a hinge (not shown in the drawings) which is provided at the lower end portion of the front surface of the case main body 2. The opening/closing plate 2*c* is for opening and closing the front surface of the case main body 2.

An after-mentioned operation unit 12 is set on the upper surface (top plate) of the case main body 2, and a display unit 13 is set at a nearly central portion of the upper surface (top plate).

The shapes and configurations of the case main body 2 and the cover 4 are not limited to the examples illustrated here.

In addition, an apparatus main body 10 of the nail print apparatus 1 is contained in the case main body 2. The apparatus main body 10 includes a printing finger fixing unit 20, a photographing unit 30 and a printing unit 40 which are shown in FIG. 2 and a control device 50 including a control unit 52 (see FIG. 6). The printing finger fixing unit 20, the photographing unit 30, the printing unit 40 and the control device 50 are provided in a machine casing 11.

The machine casing 11 is configured by including a lower machine casing 11*a* and an upper machine casing 11*b*. The lower machine casing 11*a* is formed in a box shape and is set at lower side in the case main body 2. The upper machine casing 11*b* is set above the lower machine casing 11*a* and at the upper section inside the case main body 2.

The printing finger fixing unit 20 is provided in the lower machine casing 11*a* of the machine casing 11. The printing finger fixing unit 20 is configured by including a printing finger insertion unit 20*a*, a non-printing finger insertion unit 20*b* and a holding unit 20*c* which are provided in the lower machine casing 11*a*.

Figure 3:
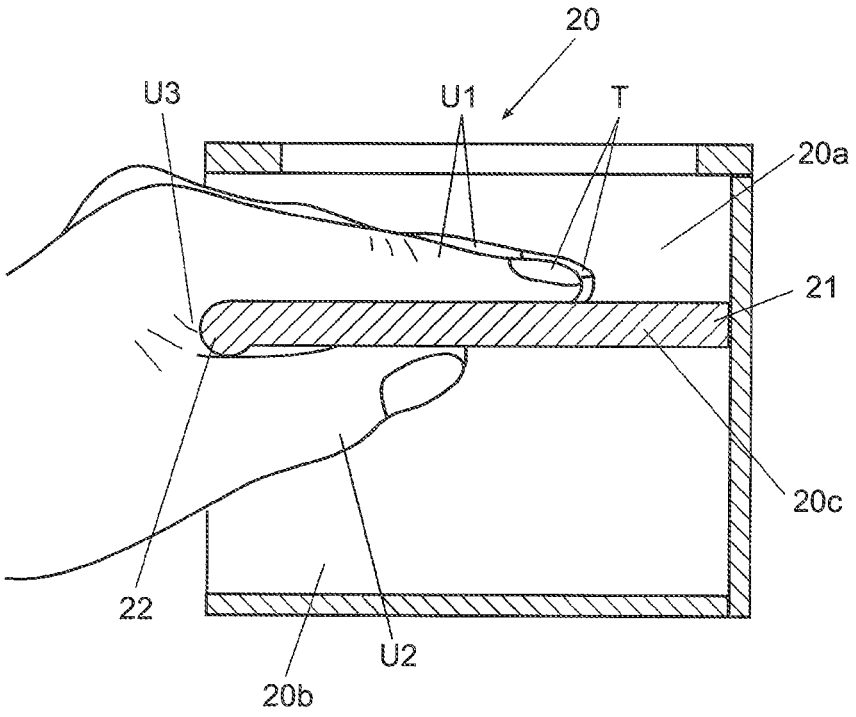
FIG. 3 is a sectional view showing a printing finger fixing unit of the nail print apparatus of FIG. 1, showing a fixed mode when an index finger to a little finger as printing fingers are inserted into a printing finger insertion unit.

FIG. 3 is a sectional view showing the printing finger fixing unit 20.

Here, fingers (hereinafter, called "printing fingers U1") corresponding to nails T to be printed are inserted into the printing finger insertion unit 20*a*. The printing fingers U1 are placed on the bottom surface (printing finger placement surface) of the printing finger insertion unit 20*a*. Photographing and printing of the printing fingers U1 are performed in a state where the printing fingers U1 are placed on the printing finger placement surface of the printing finger insertion unit 20*a*.

The non-printing finger insertion unit 20*b* is a finger insertion unit for inserting a finger (hereinafter called "non-printing finger U2") other than the printing fingers. The holding unit 20*c* is a part which can be held between the printing fingers U1 inserted in the printing finger insertion unit 20*a* and the non-printing finger U2 inserted in the non-printing finger insertion unit 20*b*. In the embodiment, the holding unit 20*c* includes a dividing wall 21 which divides the printing finger insertion unit 20*a* from the non-printing finger insertion unit 20*b*.

The upper surface of the dividing wall 21 includes a printing finger placement surface which is flat. A bulging portion 22 is formed at the end of the dividing wall 21 from where fingers are inserted. The bulging portion 22 is formed at a part where bases U3 of the printing fingers U1 and the non-printing finger U2 abut when the printing fingers U1 and the non-printing finger U2 are deeply inserted in the printing finger insertion unit 20*a* and the non-printing finger insertion unit 20*b*, respectively. The cross-section of the bulging portion 22 when cut along the finger insertion direction is circular so as to bulge downward from the lower surface of the dividing wall 21 so that the dividing wall 21 (the holding unit 20*c*) can be held firmly between the printing fingers U1 and the non-printing finger U2 in a state where the entire balls of the printing fingers U1 abut the printing finger placement surface. The shape of the bulging portion 22 is not limited to the cross-sectional circle, and may be a cross-sectional oval and a non-circle such as a polygon.

For example, in a case where four fingers (index finger, middle finger, ring finger and little finger) other than the thumb of the left hand are printing fingers U1, as shown in FIG. 3, the user inserts the four printing fingers U1 into the printing finger insertion unit 20*a* and inserts the thumb which is the non-printing finger U2 into the non-printing finger insertion unit 20*b*. In this case, the printing fingers U1 are fixed on the holding unit 20*c* by the user holding the holding unit 20*c* between the printing fingers U1 inserted into the printing finger insertion unit 20*a* and the non-printing finger U2 inserted to the non-printing finger insertion unit 20*b*.

In a case where only the thumb is a printing finger U1, the thumb (printing finger U1) is inserted into the printing finger insertion unit 20*a* and the four fingers (non-printing fingers U2) other than the thumb are inserted in the non-printing finger insertion unit 20*b*. Also in this case, the printing finger U1 is fixed by the user holding the holding unit 20*c* between the printing finger U1 and the non-printing fingers U2.

Figure 4:
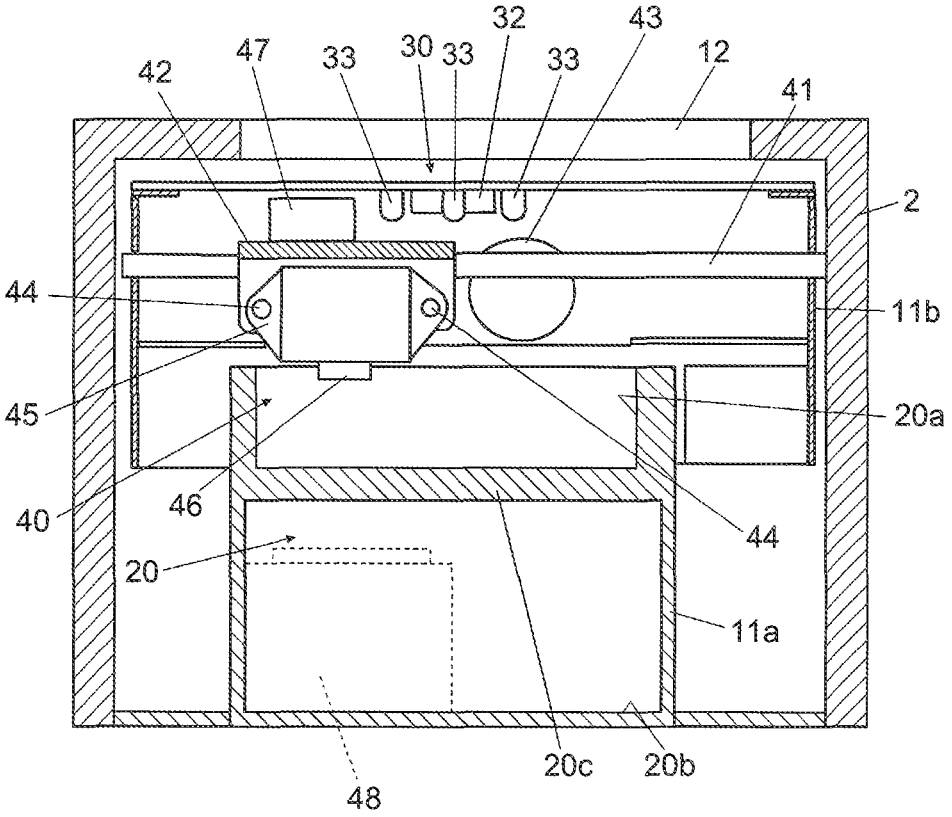
FIG. 4 is a front side sectional view of the nail print apparatus of FIG. 1.
Figure 5:
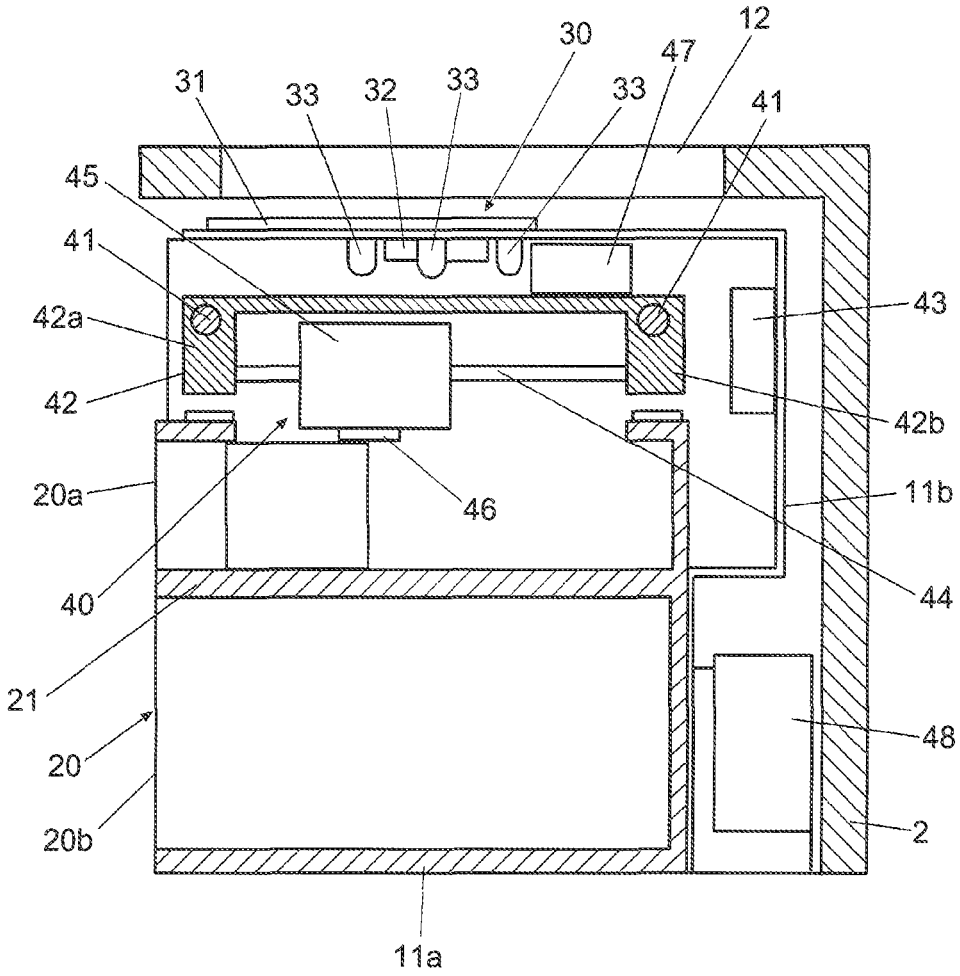
FIG. 5 is a side sectional view of the nail print apparatus of FIG. 1.

FIG. 4 is a front side sectional view of the nail print apparatus 1 according to the embodiment and FIG. 5 is a side sectional view of the nail print apparatus 1.

As shown in FIGS. 4 and 5, the photographing unit 30 is provided on the upper machine casing 11*b* of the machine casing 11.

That is, at the central portion of the lower surface of a substrate 31 which is set on the upper machine casing 11*b*, an electronic camera 32 of approximately two million pixels or more which includes a built-in driver is set. In addition, on the substrate 31, lights 33 such as white LEDs are set so as to surround the electronic camera 32. The photographing unit 30 is configured by including the electronic camera 32 and the lights 33.

The photographing unit 30 is a finger image obtaining unit which obtains a finger image including an image of a nail region Ta (see FIG. 8B, for example) of a nail T corresponding to the printing finger U1 by illuminating the printing finger U1 placed on the bottom surface (printing finger placement surface) of the printing finger insertion unit 20*a* with the lights 33 and photographing the printing finger U1 with the electronic camera 32. The photographing unit 30 is connected to a photographing control unit 522 of an after-mentioned control device 50 and is controlled by the photographing control unit 522.

The printing unit 40 performs printing of colors, patterns and such like on the nail region Ta which is a target region for printing in accordance with printing image data based on the coordinate value of the nail region Ta, and the printing unit 40 is mainly provided in the upper machine casing 11*b*.

That is, as shown in FIGS. 4 and 5, two guide rods 41 are bridged in parallel to each other between the both side boards of the upper machine casing 11*b*. A main carriage 42 is slidably set at the guide rods 41. In addition, as shown in FIG. 5, two guide rods 44 are bridged in parallel to each other between a front wall 42*a* and a rear wall 42*b* of the main carriage 42. A secondary carriage 45 is slidably set at the guide rods 44. A print head 46 is mounted on the central portion of the lower surface of the secondary carriage 45.

The print head 46 performs printing on the nail region Ta on the basis of image data which includes a first design P (see FIG. 8A, for example) such as an after-mentioned picture pattern and a second design B (see FIG. 8A, for example) that is the background of the first design.

Printing by the print head 46 is not limited to this and may be performed on the basis of image data which includes either the first design P or the second design B, for example.

In the embodiment, the print head 46 is an ink-jet type print head which makes ink be in the form of micro droplets and directly sprays the ink droplets onto a target to be printed to perform printing. Here, the recording method of the print head 46 is not limited to the ink-jet type.

The main carriage 42 is joined to a motor 43 via a power transmission unit (not shown in the drawings) and is configured to move to the left and right along the guide rods 41 by the forward-reverse rotation of the motor 43. Also, the secondary carriage 45 is joined to a motor 47 via a power transmission unit (not shown in the drawings) and is configured to move back and forth along the guide rods 44 by the forward-reverse rotation of the motor 47.

An ink cartridge 48 for supplying ink to the print head 46 is provided in the lower machine casing 11*a*. The ink cartridge 48 is connected to the print head 46 via an ink supply tube (not shown in the drawings), and appropriately supplies ink to the print head 46. Here, the configuration may be such that the ink cartridge is mounted on the print head 46 itself.

The printing unit 40 is configured by including the guide rods 41, the main carriage 42, the motor 43, the guide rods 44, the secondary carriage 45, the print head 46, the motor 47, the ink cartridge 48 and others. The motor 43, the print head 46 and the motor 47 of the printing unit 40 are connected to the print control unit 525 of the after-mentioned control device 50 and controlled by the print control unit 525.

The operation unit 12 is an input unit for a user to perform various types of input (see FIG. 1, for example).

The operation unit 12 is provided with a power switch which turns on the nail print apparatus 1, a print button which starts printing operation, a stop switch to stop the operation and operation buttons 121 for performing other various types of input, for example.

The display unit 13 is configured by including a liquid crystal panel (LCD: Liquid Crystal Display), an organic electroluminescent display and other flat display, for example. In the embodiment, on the display unit 13, a finger image obtained by photographing the printing finger U1, a nail region Ta thereof, a design selection screen for selecting a design image D to be printed on the nail T, the design image D to be printed on the nail region Ta of the printing finger U1 and thumbnail images for confirming the design image D (printing image data) which was processed by an after-mentioned image data processing unit 524 are displayed, for example.

A touch panel may be integrally formed on the surface of the display unit 13. In such case, it is configured so that various types of input can be carried out also by touching the surface of the display unit 13 by touching operation with a stylus pen which is a writing tool of sharpened stick and write down by being pressed against the touch panel surface, a fingertip and the like (not shown in the drawings), for example.

Figure 6:
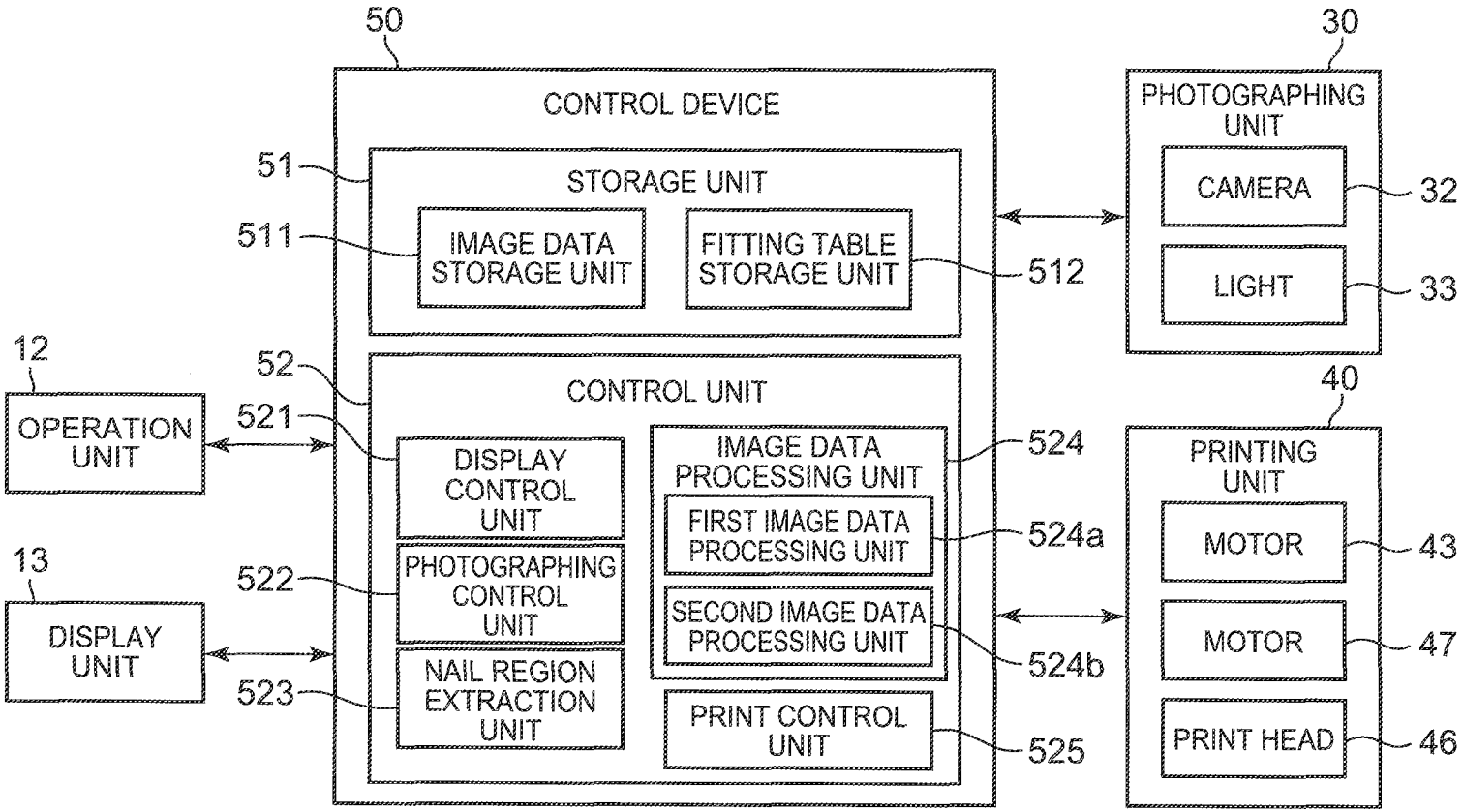
FIG. 6 is a main part block diagram showing a control configuration of the nail print apparatus according to the embodiment.

The control device 50 is set on the substrate 31 disposed on the upper machine casing 11*b* and the like, for example. FIG. 6 is a main part block diagram showing a control structure in the embodiment.

As shown in FIG. 6, the control device 50 is a computer which includes a storage unit 51 having a ROM (Read only memory), a RAM (Random access memory) and such like which are not shown in the drawings and a control unit 52 having a CPU and such like which are not shown in the drawings.

Various programs for operating the nail print apparatus 1, various data and such like are stored in the storage unit 51.

In the embodiment, the storage unit 51 is provided with an image data storage unit 511, a fitting table storage unit 512 and such like.

The image data storage unit 511 stores a plurality of image data of design images D (see FIG. 8A, for example) which include a first design P and/or a second design B that is the background of the first design.

Figure 8A:
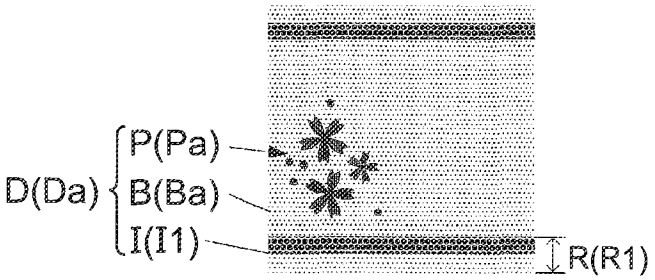
FIG. 8A is an explanation view showing an example of a design image which is subject to fitting in a design mode A.

Here, the first design P is, for example, a design formed by a one-point pattern such as a flower pattern and a star pattern. The first design P includes characters such as the kanji character, hiragana, katakana, alphabet and such like, numbers, symbols, pictograms and others. The first design P is not limited to the above examples as long as it is other than the second design that is the background of the first design. The second design B that is the back ground of the first design is a design such as a lined, checkered and marble pattern which is uniformly arranged on the entire nail. For example, the design image Da (see FIG. 7), as shown in FIG. 8A, is formed by the first design P (the picture design P of the design image Da is referred to as "first design Pa") such as pieces of a cherry blossom and the second design B (the second design B of the design image Da is referred to as "second design Ba") which has horizontal lines in the upper and lower blank areas.

Each of the image data of design images D is accompanied with access information by which each of the image data can be specified (for example, "design image Da", "design image Db", "design image Dc" and such like).

The image data of the design image D stored in the image data storage unit 511 may be single image data including the first design P and the second design B that is the background of the first design, and may be formed by including first image data which is image data of the first design and second image data which is image data of the second design.

When the image data of the design image D is configured by including the first image data and the second image data, the combination of the first image data and the second image data may be preliminary determined and both of them may be stored in the image data storage unit 511 so as to be associated with each other. The user may select one or a plurality of first image data and second image data. When the user can select the first image data and the second image data, the design image D is formed by combining one or a plurality of the first image data and the second image data selected by the user, and the selected first image data and the second image data are stored in the image data storage unit 511 so as to be associated with each other.

The image data of the design image D stored in the image data storage unit 511 may be image data formed by only one of the first design P and the second design B.

When an after-mentioned edge region I of a predetermined repeat width R is set on the second design, a fitting table storage unit 512 is an associating storage unit which stores the repeat width R and the second design so as to be associated with each other.

FIG. 7 is a diagram showing a data configuration example of the fitting table storage unit 512 in the embodiment.

As shown in FIG. 7, in the embodiment, the access information accompanying the design image D stored in the image data storage unit 511 is stored in the fitting table storage unit 512 so as to be associated with one of three kinds of design modes (design mode A, design mode B and design mode C) corresponding to the image data.

If the access information is stored so as to be associated with the design mode A, the after-mentioned repeat width R (see FIG. 8C, for example) is also stored in the fitting table storage unit 512 so as to be associated with the access information.

The design mode is a processing mode when the after-mentioned image data processing unit 524 performs fitting processing on the image data of the design image D.

For example, the design mode A corresponds to a case where the design image D has the first design P and an entire design such as a one-point flower pattern is to be included in the nail region Ta. In the design mode A, vertical and horizontal lengths of the nail region Ta are compared and fitting is performed so as to fit the design image D to the shorter length among the vertical and horizontal lengths.

The design mode B corresponds to a case where the design image D does not include the first design P and is formed only of the second design B that is the background of the first design. In the design mode B, vertical and horizontal lengths of the nail region Ta are compared and fitting is performed so as to fit the design image D to the longer length among the vertical and horizontal lengths.

The design mode C corresponds to a case where the design image D is formed of the first image data which is the image data of the first design P and the second image data which is the image data of the second design B that is the background of the first design. In the design mode C, fitting is performed on the first image data and the second image data separately.

Since the design mode and the repeat width R are stored in the fitting table storage unit 512 so as to be associated with the access information of the design image D, the image data processing unit 524 can appropriately read out the design mode and the repeat width R as needed from the fitting table storage unit 512 on the basis of the access information.

For example, when the design image D selected by a user is the "design image Da", the image data processing unit 524 reads out the design mode A and the repeat width R1 (eight pixels, see FIGS. 7 and 8A) corresponding to the design image Da on the basis of the access information of the design image Da.

The configuration of the fitting table storage unit 512 is not limited to the example described here, and the image data itself of the design image D may be stored in the fitting table storage unit 512 so as to be associated with the design mode and the repeat width R, for example. In such case, it is not necessary to provide the image data storage unit 511 separately.

The control unit 52 includes, in a view of functionality, a display control unit 521, a photographing control unit 522, a nail region extraction unit 523, an image data processing unit 524, a print control unit 525 and such like. The functions as the display control unit 521, the photographing control unit 522, the nail region extraction unit 523, the image data processing unit 524, the print control unit 525 and such like are executed in cooperation between the CPU of the control unit 52 and programs stored in the ROM and such like of the storage unit 51.

The display control unit 521 displays various types of display screens on the display unit 13.

In the embodiment, the display control unit 521 displays the design selection screen for selecting the design image D, thumbnail images for confirming the design image D (printing image data) which was processed by the image data processing unit 524, an instruction screen which displays various instructions, a notification screen, an alarm screen and such like on the display unit 13.

The photographing control unit 522 controls the photographing operation of the photographing unit 30 so as to photograph the finger image and such like of the printing finger U1 of the user. For example, when the user inserts the printing finger U1 into the printing finger insertion unit 20*a*, the photographing control unit 522 makes the photographing unit 30 photograph the condition how the printing finger U1 is being inserted into the printing finger insertion unit 20*a*. It is preferable that the image obtained by the photographing unit 30 is displayed on the display unit 13 so that the user can visually confirm the position of the printing finger U1 when setting the printing finger U1, for example.

In addition, the photographing control unit 522 makes the photographing unit 30 photograph the printing finger U1 when the printing finger U1 of the user is placed at a predetermined position in the printing finger insertion unit 20*a*. The photographing control unit 522 outputs the image obtained by the photographing unit 30 to the control unit 52.

The photographing control unit 522 may store the image data of the image obtained by the photographing unit 30 in the storage unit 51.

The nail region extraction unit 523 extracts the nail region Ta corresponding to the nail T included in the finger image of the printing finger U1 obtained by the photographing unit 30 from the finger image. In the embodiment, the nail region extraction unit 523 detects the coordinate value of the outline of the nail T of the printing finger U1 (the region represented by the coordinate value of the outline of the nail T is referred to as "nail region Ta"), the aspect ratio and such like on the basis of the finger image output by the photographing control unit 522. The print range and such like by the print head 46 are specified on the basis of the nail region Ta extracted by the nail region extraction unit 523.

The method of extracting the nail region Ta by the nail region extraction unit 523 is not specifically limited and various methods can be used.

Figure 8B:
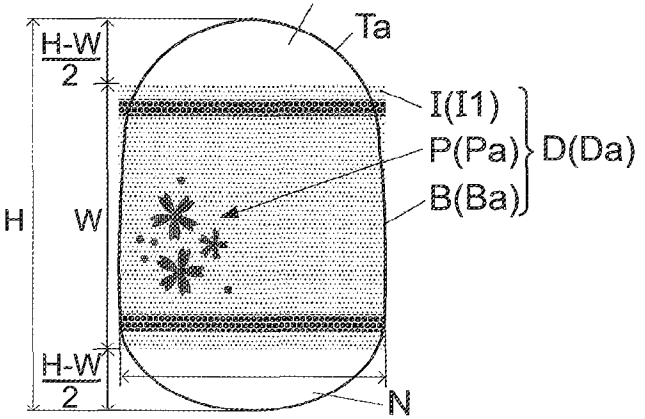
FIG. 8B is an explanation view showing a design image in which image data is processed by a first image data processing unit in the design mode A.

In the following description, W indicates the largest length in the horizontal direction of the nail region Ta (the length of a portion which is widest in the nail region Ta), and H indicates the largest length in the vertical direction of the nail region Ta (see FIG. 8B, for example).

The image data processing unit 524 includes a first image data processing unit 524*a* and a second image data processing unit 524*b*. The image data processing unit 524 reads out and obtains the image data of the design image D corresponding to the access information from the image data storage unit 511, and reads out and obtains the design mode stored so as to be associated with the access information from the fitting table storage unit 512 on the basis of the access information of the design image D.

Here, in a case where the design mode A is stored so as to be associated with the access information, the image data processing unit 524 further obtains the repeat width R stored so as to be associated with the access information.

Also, the image data processing unit 524 performs processing on the image data of the design image D with the first image data processing unit 524*a* and/or the second image data processing unit 524*b* on the basis of the nail region Ta obtained by the nail region extraction unit 523 and the design mode, to process the design image D.

Then, the image data processing unit 524 cuts out the design image D so as to fit to the nail region Ta on the basis of the image data of the design image D processed by the first image data processing unit 524*a* and/or the second image data processing unit 524*b*, and outputs the image data of the cut design image D as printing image data to the print control unit 525.

When the design mode corresponding to the design image D is the design mode A, the first image data processing unit 524*a* processes the image data of the design image D so as to position the first design P (see FIG. 8C, for example) inside the nail region Ta.

When the design image D corresponds to the design mode C, the first image data processing unit 524*a* processes the image data of the first design P so that the first design P covers the nail region Ta.

Specific processing by the first image data processing unit 524*a* is not specifically limited. However, in the embodiment, in a case where the design image D corresponds to the design mode A or C, the image data of the design image D is processed so as to fit to the shorter length (usually, the horizontal length W of the nail region Ta) among the vertical and horizontal lengths of the nail region Ta, and the design image D is reduced or enlarged with the equal aspect ratio so as to position the first design P (see FIG. 8A) in the nail region Ta. Thus, the first design P is reduced or enlarged with the equal aspect ratio so as to fit to the size of the nail region Ta.

The processing performed by the first image data processing unit 524*a* may include processing such as rotating and moving the first design P, for example.

When the design image include the second design B (see FIG. 8A), the second image data processing unit 524*b* processes the image data of the design image D so that the second design B covers (includes) the nail region Ta.

In the embodiment, when the design image D corresponds to the design mode A, the second image data processing unit 524*b* obtains the repeat width R from the fitting table storage unit 512. The repeat width R is a length for defining an edge region I (see FIG. 8A) of the design image D and is specified by the number of pixels in the embodiment. The edge region I is set as a region for amount of the pixels of the repeat width R from the end of the second design B (see the repeat width R1 and the edge region I1 in FIG. 8A). The second image data processing unit 524*b* repeatedly provides the edge region I from the ends of the second design B toward the outside of the design image D, and thereby performs processing to extend the second design B.

When the design image D corresponds to the design mode B or C, the second image data processing unit 524*b* processes the image data of the second design B so as to cover the nail region Ta and performs processing so as to reduce or enlarge the second design B with the equal aspect ratio.

The processing performed by the second image data processing unit 524*b* is not limited to the above example. For example, the processing performed by the second image data processing unit 524*b* may include moving and rotating the second design B.

Here, as for fitting of the design image D in each of the design modes by the image processing unit 524, specific examples will be described with reference to FIGS. 8 to 11D.

Here, for ease of explanation, the design image D used for explaining each of the design modes is assumed to be in a square shape which is larger than the nail T. Also, for ease of explanation, it is assumed that the image data processing unit 524 directly processes the design image D and not the image data, though the image data processing unit 524 actually processes the image data to perform fitting of the design image D.

First, the fitting processing by the design mode A will be described taking a case of fitting the design image Da (see FIG. 7) as an example.

Figure 8C:
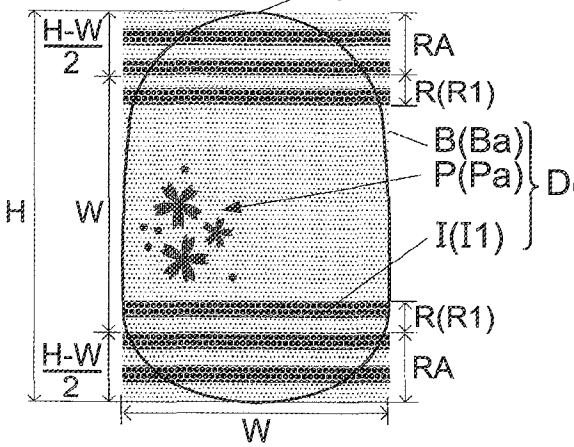
FIG. 8C is an explanation view showing a design image in which image data is processed by a second image data processing unit in the design mode A.
Figure 8D:
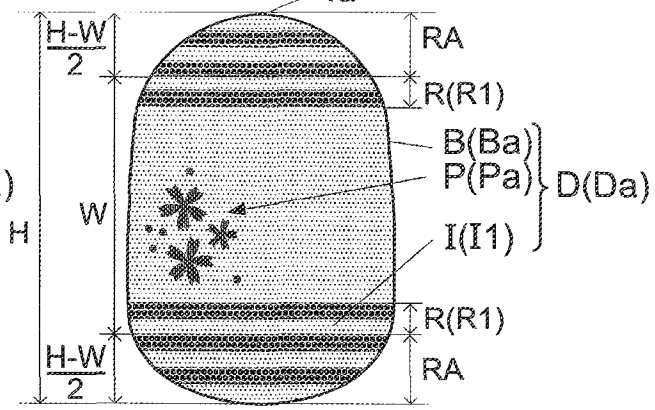
FIG. 8D is an explanation view showing a design image on which fitting is performed by an image data processing unit in the design mode A.

FIG. 8A is an explanatory diagram showing an example of the design image Da which is subject to fitting in the design mode A. FIG. 8B is an explanatory diagram showing a state where the image data of the design image Da is processed by the first image data processing unit 524*a* in the design mode A. FIG. 8C is an explanatory diagram showing a state where the image data of the design image Da is processed by the second image data processing unit 524*b* in the design mode A. FIG. 8D is an explanatory diagram showing a state where the design image Da is fitted to the nail region Ta by the image data processing unit 524 in the design mode A.

The design image Da shown in FIG. 8A, for example, includes the first design Pa and the second design Ba. The edge region I1 with the length of the repeat width R1 (eight pixels long in the illustrated example) is set on both upper and lower ends of the second design Ba. As shown in FIG. 8A, the edge region I1 forms a single unit of horizontal stripes. The design mode corresponding to the design image Da and the repeat width R1 for defining the edge region I1 are, as shown in FIG. 7, stored in the fitting table storage unit 512 so as to be associated with the access information, and readout from the fitting table storage unit 512 by the image data processing unit 524.

The first image data processing unit 524*a* reduces the design image Da with the equal aspect ratio so as to adjust the vertical and horizontal lengths of the design image Da to the shorter length among the vertical and horizontal lengths of the nail region Ta (the horizontal length W of the nail region Ta in the embodiment). Here, it is assumed that the vertical and horizontal lengths of the design image Da are reduced by half. In such case, the repeat width R1 is also reduced with the same rate to be four pixels and each of the edge regions I1 is reduced by half in vertical and horizontal lengths.

Next, the first image data processing unit 524*a* superimposes the center of the reduced design image Da on the center of the nail region Ta. Since the design image Da is in the square shape here, both of the vertical and horizontal lengths of the design image Da are equal to the horizontal length W of the nail region Ta. The largest vertical length of the nail region Ta is H. Thus, as shown in FIG. 8B, the nail region Ta has a blank region N with the length of (H−W)/2 at each of the upper and lower end portions.

Next, the second image data processing unit 524*b* repeatedly provides the reduced edge region I1 vertically from both upper and lower ends of the second design Ba of the reduced design Da, and thereby extends the second design Ba. The second image data processing unit 524*b* extends the second design Ba by repeatedly providing the edge region I1 vertically until there is no more the blank region N, that is, until the vertical length (total of repeat length RA) of the total amount (total repeat amount) of the extended edge region I1 becomes equal to or longer than (H−W)/2 (see FIG. 8C). Thus, the second design Ba becomes large enough to cover the entire nail region Ta.

Next, the image data processing unit 524 cuts off the second design Ba running off the edge of the nail region Ta and fits the design image Da to the shape of the nail region Ta (see FIG. 8D). Thus, the design image Da is fitted to the nail region Ta.

The configuration of the design image D is not limited to the example described here. For example, as shown in FIG. 9, the second design Bd of the design image Dd may include an edge region I2 of a predetermined repeat width R2 at each of the horizontal ends of the second design Bd.

Though the first image data processing unit 524*a* reduces the design image Da so that the vertical and horizontal lengths of the design image Da become the horizontal length W of the nail region Ta in the above example (see FIG. 8), the fitting length is not limited to the horizontal length W of the nail region Ta.

Figure 9:
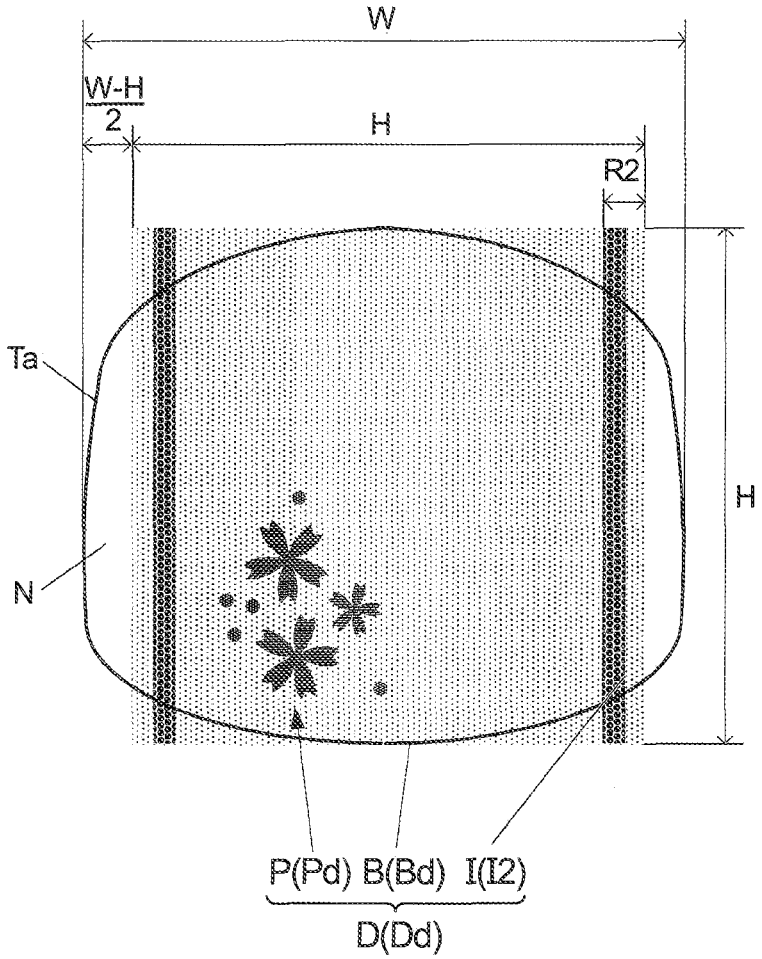
FIG. 9 is an explanation view showing an example of a design image which includes an edge region at each of the right and left ends of the second design.

For example, as shown in FIG. 9, when the vertical length H of the nail region Ta is shorter than the horizontal length W of the nail region Ta, the design image Dd is reduced or enlarged so that both of the vertical and horizontal lengths of the design image Dd become the vertical length H of the nail region Ta. Thus, even when the nail T is horizontally long, the first design Pd is appropriately positioned in the nail region Ta. In such case, a blank region N having the length of (W−H)/2 is generated at each of the horizontal ends (see FIG. 9). When the second design Bd of the design image Dd includes an edge region I2 with the length of a predetermined repeat width R2 at each of the horizontal ends, the second image data processing unit 524*b* extends the edge region I2 horizontally until there is no more the blank region N, and thereby printing can be performed on the entire nail region Ta without leaving unprinted region.

Next, the fitting processing in the design mode B will be described by taking a case of fitting of the design image Db (see FIG. 7) as an example. Hereinafter, a case where vertical length H of the nail region Ta>horizontal length W of the nail region Ta is described as an example.

Figure 10A:
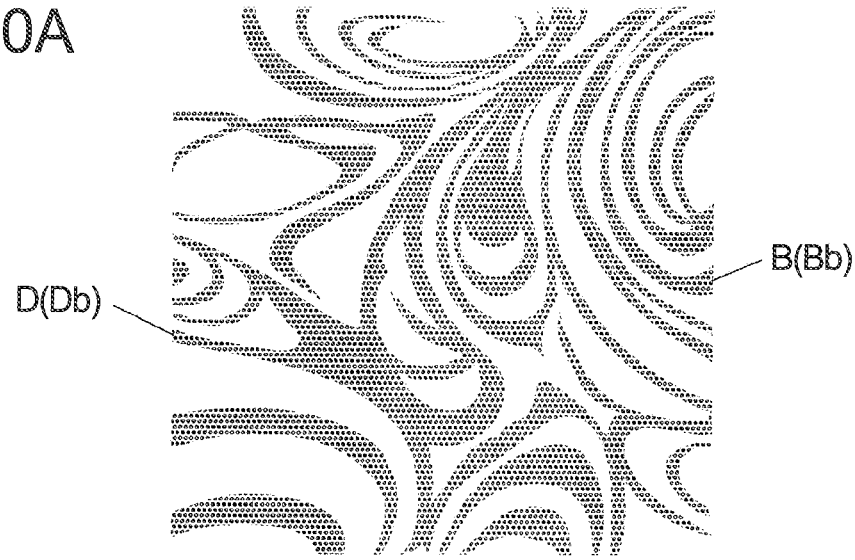
FIG. 10A is an explanation view showing an example of a design image which is subject to fitting in a design mode B.
Figure 10B:
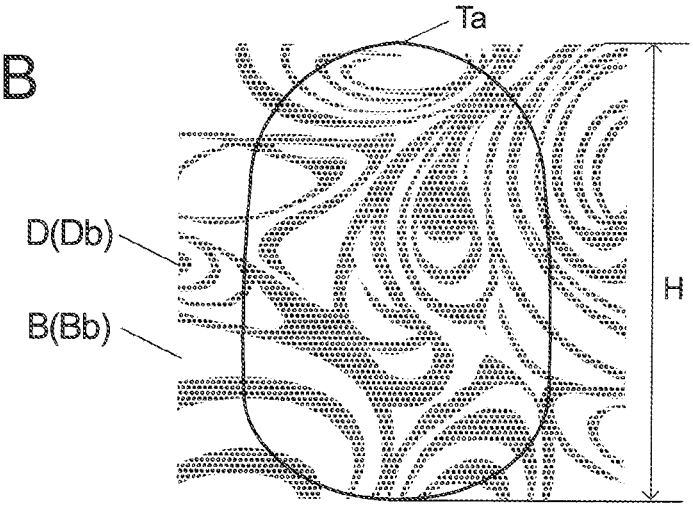
FIG. 10B is an explanation view showing a design image in which image data is processed by a second image data processing unit in the design mode B.
Figure 10C:
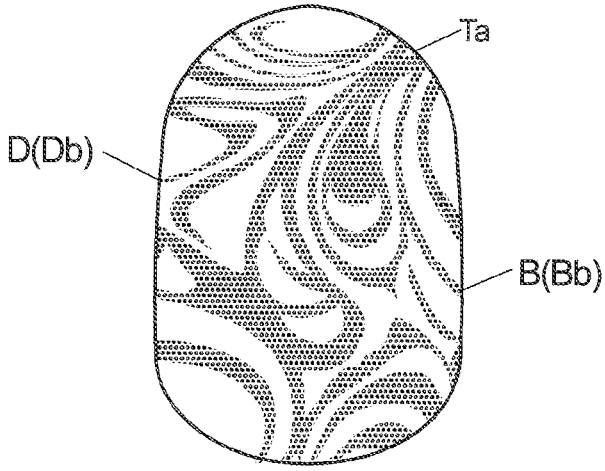
FIG. 10C is an explanation view showing a design image on which fitting is performed by an image data processing unit in the design mode B.

FIG. 10A is an explanatory diagram showing an example of the design image Db which is subject to fitting in the design mode B. FIG. 10B is an explanatory diagram showing a state where the image data of the design image Db is processed by the second image data processing unit 524*b* in the design mode B. FIG. 10C is an explanatory diagram showing a state where the design image Db is fitted to the nail region Ta by the image data processing unit 524 in the design mode B.

The design mode B is a fitting mode when the design image D is formed only of the second design as described above. Specifically, for example, the design mode B is the design mode when the design image Db is formed of the second design Bb which is an overall pattern to be printed on the entire nail region Ta without a one-point pattern as shown in FIG. 10A.

First, the second image data processing unit 524*b* reduces the design image Db with the equal aspect ratio so that the vertical and horizontal lengths of the design image Db become the longer length among the vertical and horizontal lengths of the nail region Ta (the vertical length H of the nail region Ta in the embodiment) (see FIG. 10B). Then, the image data processing unit 524 cuts off the design image Db running off the edge of the nail region Ta and fits the design image Db into the shape of the nail region Ta (see FIG. 10C). Thus, the design image Db is fitted to the nail region Ta.

The pattern of the design image D which is subject to fitting in the design mode B is not limited to a pattern such as the design image Db in the illustrated example. For example, the design image D may be an overall pattern such as fine pattern which is scattered with small designs.

Though the second image data processing unit 524*b* reduces the design image D with the equal aspect ratio so that the vertical and horizontal lengths of the design image D are the vertical length H of the nail region Ta in the above example, the fitting length is not limited to the vertical length H of the nail region Ta.

For example, in a case where the vertical length H of the nail region Ta is shorter than the horizontal length W of the nail region Ta as shown in FIG. 9, the second image data processing unit 524*b* reduces or enlarges the design image D with the equal aspect ratio so that the vertical and horizontal lengths of the design image D become the horizontal length W of the nail region Ta. Thus, even when the nail T is horizontally long, the second design B is placed so as to cover the entire nail region Ta.

Next, fitting performed in the design mode C will be described by taking a case of fitting the design image Dc (see FIG. 7) as an example.

Figure 11A:
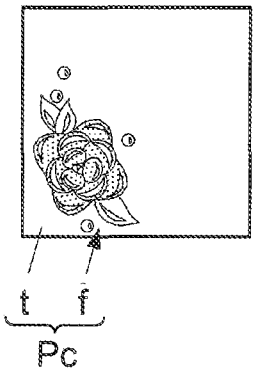
FIG. 11A is an explanation view showing an example of a first design which is subject to fitting in a design mode C.
Figure 11B:
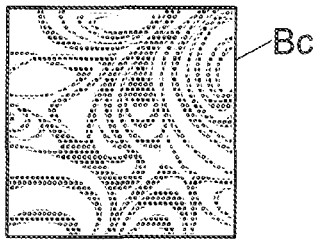
FIG. 11B is an explanation view showing an example of a second design which is subject to fitting in the design mode C.
Figure 11C:
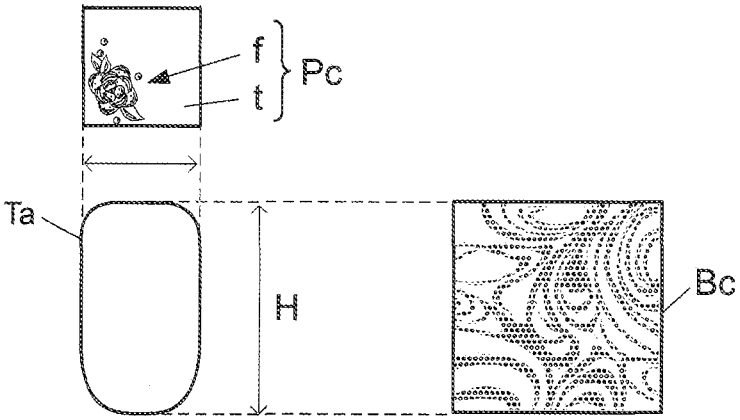
FIG. 11C is an explanation view explaining processing performed by the first image data processing unit and the second image data processing unit in the design mode C.
Figure 11D:
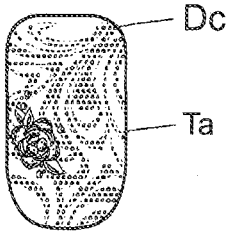
FIG. 11D is an explanation view showing a design image on which fitting is performed by an image data processing unit in the design mode C.

FIG. 11A is an explanatory diagram showing an example of the first design Pc to form the design image Dc which is subject to fitting in the design mode C. FIG. 11B is an explanatory diagram showing an example of the second design Bc to form the design image Dc. FIG. 11C is an explanatory diagram explaining processing of the image data performed by the first image data processing unit 524*a* and the second image data processing unit 524*b* in the design mode C. FIG. 11D is an explanatory diagram showing a state where the design image Dc is fitted to the nail region Ta by the image data processing unit 524 in the design mode C.

Here, it is assumed that the image data of the design image Dc which is subject to fitting in the design mode C is formed of the first image data which is the image data of the first design Pc (see FIG. 11A) and of the second image data which is the image data of the second design Bc (see FIG. 11B). It is also assumed that the first design Pc in the embodiment is in a square shape including a flower pattern portion f which is colored and a transparent portion t which is not colored and transparent.

In the design mode C, as shown in FIG. 11C, the first image data processing unit 524*a* reduces, for the first image data, the first design Pc with the equal aspect ratio so that the vertical and horizontal lengths of the first design Pc are the horizontal length W of the nail region Ta.

Then, the second image data processing unit 524*b* reduces the second design Bc with the equal aspect ratio so that the vertical and horizontal lengths of the second design Bc are the vertical length H of the nail region Ta for the second image data.

The image data processing unit 524 superimposes the reduced first design Pc on the reduced second design Bc, cuts off the second design Bc running off the edge of the nail region Ta and fits the first design Pc and the second design Bc into the shape of the nail region Ta. Thus, as shown in FIG. 11D, the design image Dc is fitted to the nail region Ta.

The configuration of the design image Dc is not limited to the example described here. For example, the image data of the design image Dc may be formed of a first design Pc which includes a plurality of first designs. In such case, the above fitting by the first image data processing unit 524*a* is performed for all of the first designs Pc and then all the image data is superimposed.

The print control unit 525 controls the printing unit 40 on the basis of the printing image data input from the image data processing unit 524 so as to print the design image D, with the print head 46, on the nail T (nail region Ta) of the finger (printing finger U1) inserted into the printing finger insertion unit 20*a*.

Next, a print control method of the nail print apparatus 1 in the embodiment will be described with reference to FIGS. 12 to 13.

Figure 12:
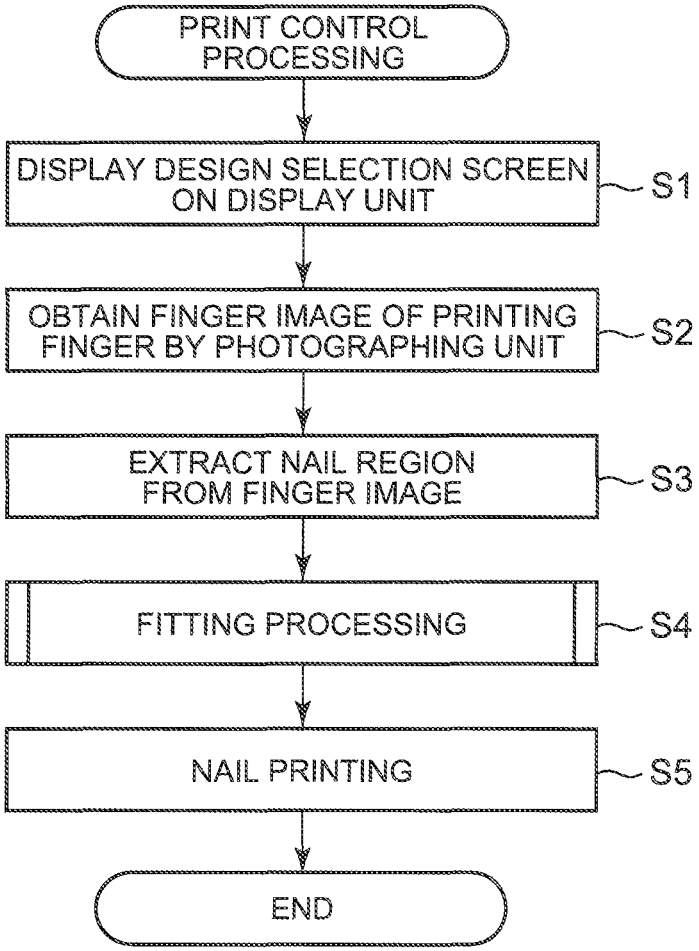
FIG. 12 is a flowchart showing print control processing performed by the nail print apparatus.
Figure 13:
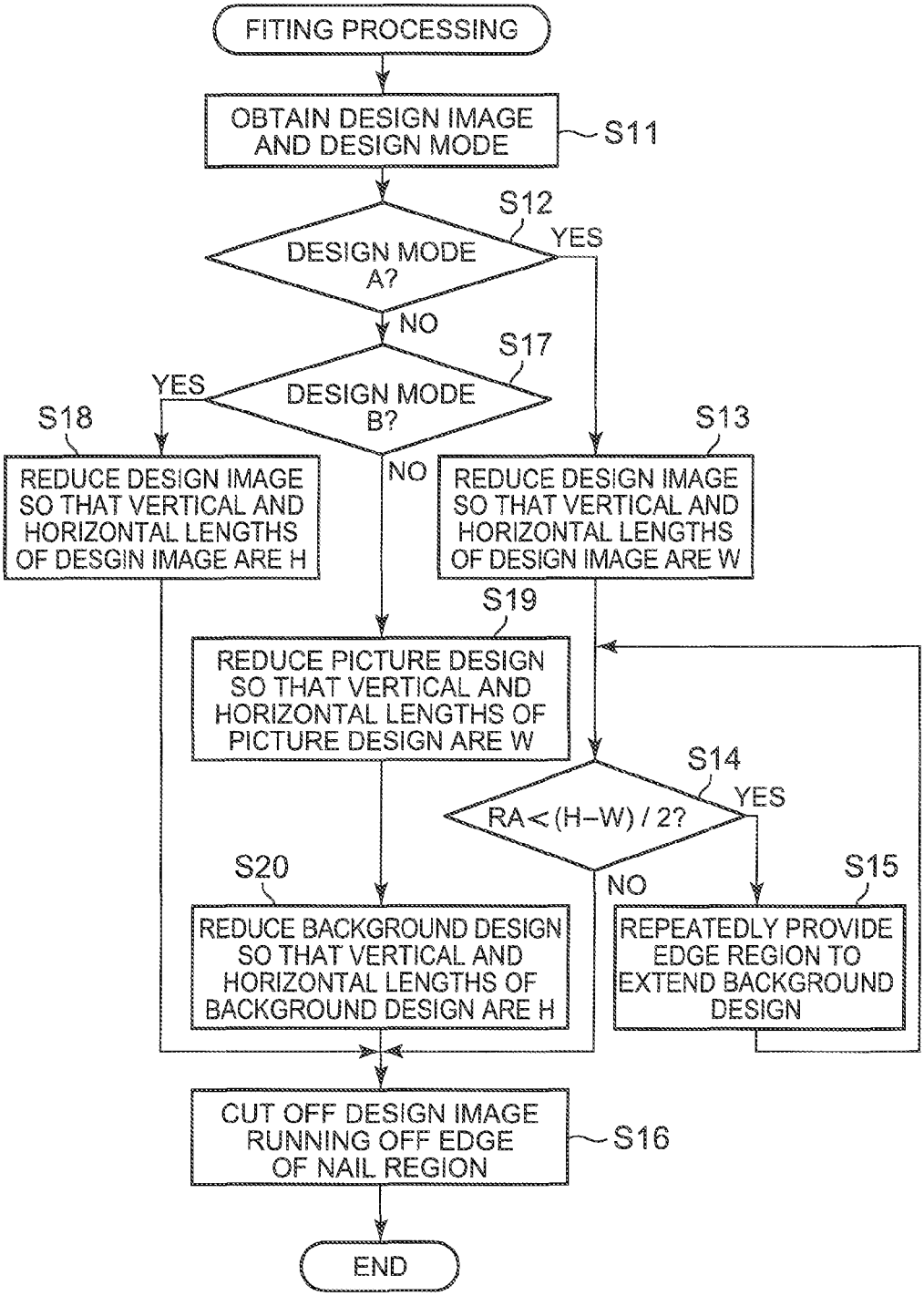
FIG. 13 is a flowchart showing the fitting processing in FIG. 12.

FIG. 12 is a flowchart showing print control processing performed by the nail print apparatus 1, and FIG. 13 is a flowchart showing fitting processing performed by the nail print apparatus 1.

For ease of explanation, it is assumed that the design image Da and such like used in the following description are in a square shape which is larger than the nail T and the longer length among the vertical and horizontal lengths of the nail region Ta is the vertical length H of the nail region Ta.

When printing is to be performed by the nail print apparatus 1, the user turns on the power switch to activate the control device 50 at first.

The display control unit 521 makes the display unit 13 display a design selection screen (not shown in the drawings) (step S1). Thus, the user operates the operation buttons 121 and such like of the operation unit 12 to select a desired design image D from the plurality of design images D displayed on the design selection screen, and thereby the access information of the design is output from the operation unit 12 to the control unit 52 to specify the design image to be printed.

Next, the user inserts printing fingers U1 into the printing finger insertion unit 20*a* and a non-printing finger U2 into the non-printing finger insertion unit 20*b* to fix the printing fingers U1 and then operates the print switch.

For example, when printing is to be performed on nail regions Ta of the index finger, middle finger, ring finger and little finger of the left hand, as shown in FIG. 3, the user inserts the index finger, middle finger, ring finger and little finger into the printing finger insertion unit 20*a* so as to be next to each other on a plane and inserts the thumb into the non-printing finger insertion unit 20*b*. Then, the user holds the holding unit 20*c* between the index finger, middle finger, ring finger and little finger inserted into the printing finger insertion unit 20*a* and the thumb inserted into the non-printing finger insertion unit 20*b*. Thus, the index finger, middle finger, ring finger and little finger which are the printing fingers U1 are fixed.

When an instruction is input from the print switch of the display unit 13, the control device 50 controls the photographing unit 30 at first so as to photograph each of the entire printing fingers U1 before starting the print operation.

Thus, the finger image of each of the printing fingers U1 is obtained (step S2). The nail region extraction unit 523 extracts the nail region Ta to be printed from the finger image (step S3).

Next, the fitting processing is performed mainly by the image data processing unit 524 (step S4).

As shown in FIG. 13, in the fitting processing, the image data processing unit 524 reads out and obtains the image data of the design image D corresponding to the access information specified by the instruction signal which was input to the control unit 52 from the image data storage unit 511 and reads out and obtains the design mode corresponding to the access information from the fitting table storage unit 512 (step S11).

The image data processing unit 524 determines whether the obtained design mode is the design mode A (step S12). Then, if it is determined that the obtained design mode is the design mode A (step S12: YES), the repeat width R stored so as to be associated with the access information is also obtained. Next, the first image data processing unit 524*a* processes the image data of the design image D so that the first design P is located within the nail region Ta. Here, the design image D is reduced with the equal aspect ratio so that the vertical and horizontal lengths of the design image D are the horizontal length W of the nail region Ta (step S13). Further, the first image data processing unit 524*a* superimposes the center of the reduced design image D on the center of the nail region Ta. In such case, unless the vertical and horizontal lengths of the nail region Ta are equal to each other, the nail region Ta has the blank region N having the vertical length of (H−W)/2 at each of the upper and lower end portions of the nail region Ta as shown in FIG. 8B, for example.

The second image data processing unit 524*b* determines whether the blank region N exists, that is, whether the vertical length (total repeat length RA) of the total amount (total repeat amount) of the extended edge region I is smaller than (H−W)/2 (step S14). If it is determined that the total repeat length RA is shorter than the (H−W)/2 (step S14: YES), the edge region I is repeatedly provided in the vertical direction of the second design B to extend the second design B (step S15), and steps S14 to S15 are repeated until it is determined that the total repeat length RA is not shorter than the (H−W)/2 (the total repeat length RA is equal to or longer than the (H−W)/2).

If it is determined that the total repeat length RA is equal to or longer than the (H−W)/2 (step S14: NO), the image data processing unit 524 cuts off the design image D running off the edge of the nail region Ta and fits the design image D to the shape of the nail region Ta (step S16). The image data processing unit 524 outputs the image data (printing image data) of the design image D fitted into the shape of the nail region Ta to the print control unit 525, and the fitting processing ends.

If it is not determined that the obtained design mode is the design mode A (step S12: NO), the image data processing unit 524 determines whether the obtained design mode is the design mode B (step S17). If it is determined that the obtained design mode is the design mode B (step S17: YES), the second image data processing unit 524*b* reduces the design image D with the equal aspect ratio so that the vertical and horizontal lengths of the design image D are the vertical length H of the nail region Ta as shown in FIG. 10B (step S18). Thereafter, the processing proceeds to step S16 and the image data processing unit 524 cuts off the design image D running off the edge of the nail region Ta and fits the design image D into the shape of the nail region Ta.

If it is not determined that the obtained design mode is the design mode B (step S17: NO), that is, when the obtained design mode is the design mode C, the first image data processing unit 524*a* reduces the first design P with the equal aspect ratio so that the vertical and horizontal lengths of the first design P are the horizontal length W of the nail region Ta as shown in FIG. 11C (step S19). Then, the second image data processing unit 524*b* reduces the second design B with the equal aspect ratio so that the vertical and horizontal lengths of the second design B are the vertical length H of the nail region Ta (step S20). The image data processing unit 524 superimposes the reduced first design P on the reduced second design B.

Thereafter, the processing proceeds to step S16, and the image data processing unit 524 cuts off the second design B running off the edge of the nail region Ta and fits the design image D to the shape of the nail region Ta.

Back to FIG. 12, the print control unit 525 controls the printing unit 40 so as to print the design image D on the nail region Ta with the print head 46 on the basis of the printing image data input from the image data processing unit 524 (step S5, nail printing). When nail printing is set to be performed on a plurality of printing fingers U1 as in a case where printing is preliminarily set to be performed on all the fingers of the both hands, the control unit 52 determines whether the printing of the design image D is completed for all the fingers to be printed, and if the printing is determined to be completed, the print control processing ends.

As described above, according to the nail print apparatus 1 in the embodiment, depending on the design mode, the design image D is reduced or enlarged with the equal aspect ratio so that the first design P is located in the nail region Ta, the second design B is processed so as not to generate the blank region N in the nail region Ta, and thereby the design image D is fitted to the nail region Ta. Thus, the user does not need to manually fit the large design image D to the nail region Ta by each nail, and can automatically fit the design image D to the nail region Ta appropriately and thus can enjoy the nail printing casually. Furthermore, when fitting the design image D to the nail region Ta, it is possible to prevent the running off of the first design P from the nail region Ta, the distortion of the first design P due to the altered aspect ratio and the generation of the unprinted area.

In addition, in the design mode A, the repeat width R is set on the fitting table storage unit 512. Thus, a pattern which is not a plain pattern but makes a single pattern by repeating such as a border pattern and a checkered pattern can also be the edge region I, and design images D of various patterns can be printed.

Also, when the image data of the design image D has the image data of the first design P and the image data of the second design B, the first design P and the second design B are separately reduced or enlarged with the equal aspect ratio, and thereby fitted to the nail region Ta regardless of the shape of the nail T. Thus, the repeat width R need not be stored in the fitting table storage unit 512, and the capacity of the storage unit 51 can be saved. Thus, more design images D can be stored in the image data storage unit 511.

The fitted design image D is displayed on the display unit 13. Thus, the user can confirm whether the fitted design image D is the intended image, which is convenient.

Also in such case, when the user confirms the fitted design image D and determines to let the printing start, the user operates the operation button 121 which instructs the start of printing. If the user determines to change the design image D, the user can return the screen to the design selection screen by operating the operation button 121 which instructs the change. Thereby, the user can correct the design image D before printing when the design image D is not fitted well, which is convenient.

Though the embodiment of the present invention has been described above, the present invention is not limited to the embodiment and various changes can be made within the scope of the invention.

For example, in the embodiment, the second image data processing unit 524*b* processes the image data of the design image D so as to extend the second design B by repeatedly providing the edge region I of the repeat width R, which is stored in the fitting table storage unit 512 so as to be associated with the second design B, from the ends of the second design B so that the extended second design covers the nail region Ta. However, the present invention is not limited to this, and the repeat width R may not be stored in the fitting table storage unit 512. In such case, for example, the second image data processing unit 524*b* may regulate a predetermined repeat width R common to second designs B so that the second design B covers the nail region Ta, and repeatedly provide the edge region I of the predetermined repeat width from the ends of the second design B to process the image data of the design image D so as to extend the second design B. In such case, since the repeat width R is not stored in the fitting table storage unit 512, data amount is reduced and more access information and design modes can be stored so as to be associated with each other.

Also, in such case, the edge region I may be defined with a repeat width of one pixel as a predetermined repeat width R common to design images D. By such configuration, the image data processing unit 524 need not process the image data of the large size edge region I, and can fit the design image D rapidly. Here, it is preferable that the ends of the design image D have a pattern such as a plain pattern which generates the same pattern even after it is repeatedly provided. Further, by providing such edge region on the design image D, the user can confirm the entire design image. D easily. Also, the user can predict the design image D after being fitted to the nail region Ta, and thus the user can select the design easily, which is convenient.

In the embodiment, when the design mode associated with the design image D is the design mode C, the second image data processing unit 524*b* processes the image data of the second design B to reduce or enlarge the second design B with the equal aspect ratio so that the second design B covers the nail region Ta; however, the processing performed by the second image data processing unit 524*b* is not limited to this.

For example, the second image data processing unit 524*b* may repeatedly provide the edge region I of a predetermined repeat width R from the ends of the second design B to process the image data so as to extend the second design B. Thus, for example, in a case where the second design B has a pattern such as a plain pattern and a fine dotted pattern which generates the same pattern even after being repeated at the ends of the second design B, the user can easily extend the second design B and confirm the entire design image D. The user can predict the design image D after being fitted to the nail region Ta and thus select the design easily, which is convenient.

Further, for example, an edge region I of a predetermined repeat width R may be set on the second design B, and the repeat width R and the second design B may be stored in the fitting table storage unit 512 so as to be associated with each other. In such case, the second image data processing unit 524*b* repeatedly provides, from the ends of the second design B, the edge region I of the repeat width R stored so as to be associated with the second design B, and thereby processes the image data so as to extend the second design B. Thus, for example, a pattern such as a striped pattern and a checkered pattern which is not a plain pattern and generates a single pattern by repeating the predetermined width can also be the edge region I, and thus printing can be performed for design images D of various patterns.

In the embodiment, the design image D is stored in the image data storage unit 511; however the present invention is not limited to this. For example, the nail print apparatus 1 may include a receiving unit which can receive wireless communication such as IrDA (Infrared DATA Association) so that image data separately prepared by the user can be received via the wireless communication. Thus, the user can separately prepare the design image D and thus have more choices of the design image D and select the design image D corresponding to various situations, which is convenient. In such case, it is preferable that the nail print apparatus 1 in the embodiment enables the user to select the design mode which is most appropriate to the design image D separately prepared by the user. Thus, even when the design image D is separately prepared by the user, fitting of the design image D can be automatically performed in the appropriate design mode, which is convenient.

Further, the image data storage unit 511 may newly store the image separately prepared by the user. In such case, it is preferable that the nail print apparatus 1 stores the separately prepared design image D so as to be associated with the access information in the image data storage unit 511 and stores the access information and the design mode selected by the user in the fitting table storage unit 512 so as to be associated with each other. This saves the trouble of selecting the design mode and enables rapid printing of the design image D when the user selects the design image D again.

Also, the embodiment describes the example where the design image D is fitted to the nail by being reduced with the equal aspect ratio; however, the present invention is not limited to this. Especially, the above described design image D which is separately prepared by the user is smaller than the nail in some cases. In such case, it is preferable that the image data processing unit 524 performs fitting to the nail by processing the image data of the design image D so as to enlarge the design image D.

Though the embodiment includes three kinds of design modes which are the design mode A, the design mode B and the design mode C, the present invention is not limited to this and various changes can be made appropriately. For example, only two design modes such as the design mode A and the design mode C may be included, and another design mode may be added. In such case, processing by the first image data processing unit 524*a* and the second image data processing unit 524*b* are not limited to the example described here, and changes can be made appropriately.

Though the design image D was assumed to be in a square shape for ease of explanation, it is actually preferable that the image data storage unit 511 stores a design image D which is formed of 700×800 pixels. When printed in a resolution of 600 dpi, such design image D becomes approximately 3 cm×4 cm in apparent size, which is larger than a general nail T. Thus, such design image D is not enlarged at the fitting processing. This enables printing clear design image D on the nail T without enlarging the design image D printed on the nail to blur.

Also, when the design image D has vertical and horizontal lengths different from each other as in the above case, it is preferable that the first image data processing unit reduces or enlarges the design image D with the equal aspect ratio so that the design image D is included in the nail region Ta. Thus, the first design P (see FIG. 8A) included in the design image D is reduced or enlarged with the equal aspect ratio to be located in the nail region Ta. This prevents, even when the design image D has vertical and horizontal lengths different to each other, running off of the first design P from the nail region Ta, distortion of the first design P due to the altered aspect ratio and the generation of unprinted area. Also, in this case, the direction to extend the second design B by the second image data processing unit 524*b* can be appropriately changed according to the generated blank area N (see FIGS. 8B and 9).

Figure 14:
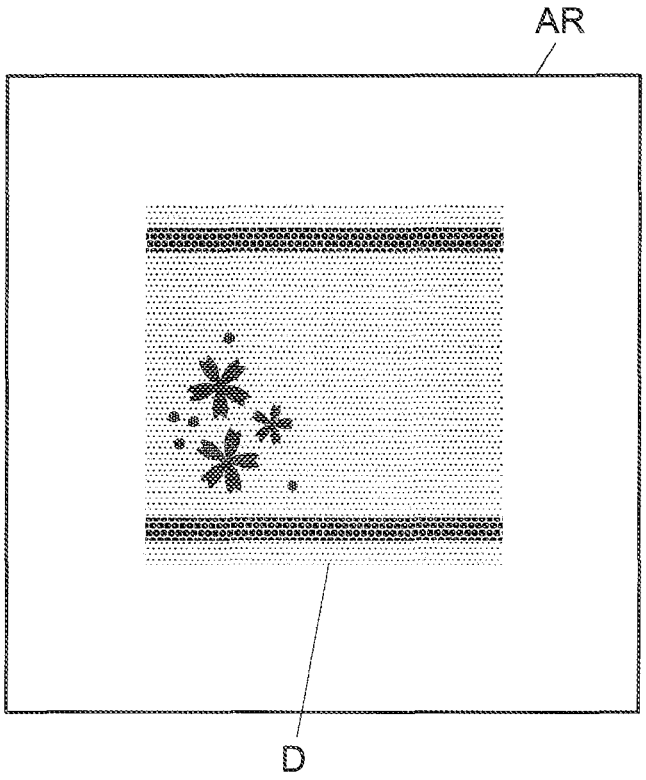
FIG. 14 is an explanation view showing an example of a design image which includes a peripheral blank region.

Further, as shown in FIG. 14, the design image D may include a peripheral blank region AR in a square shape therearound. The peripheral blank region AR is a region where the design image D can be moved arbitrarily. Thus, the image data processing unit 524 can perform fine adjustment of positioning the design image D which was fitted to the nail region Ta of the user so as to fit to the nail region Ta.

Figure 15A:
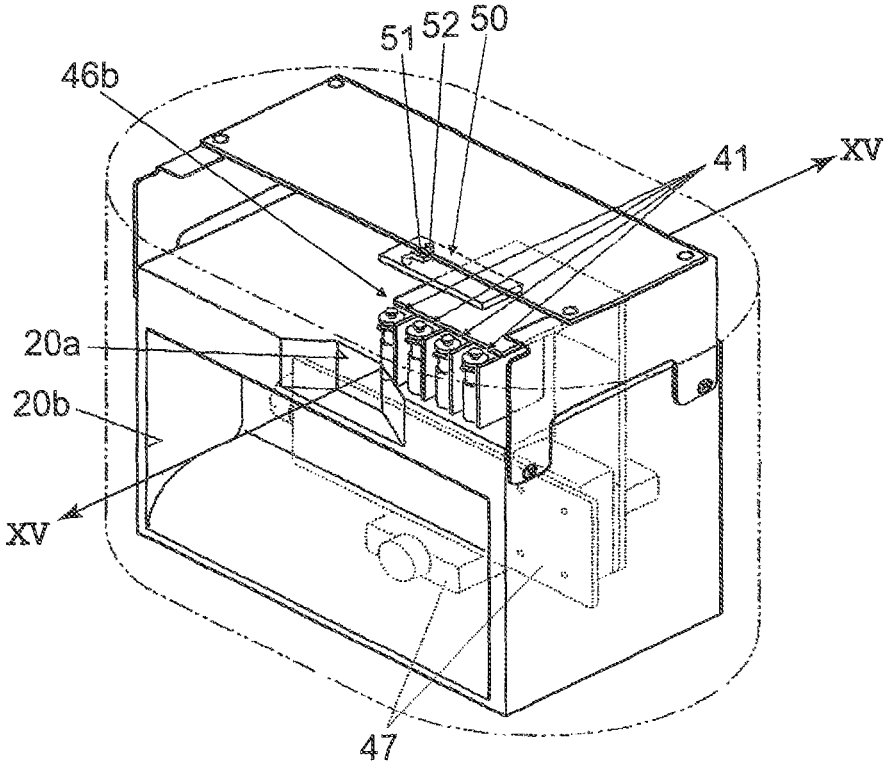
FIG. 15A is a front view of the apparatus main body of the nail print apparatus.

In the above embodiments, there is described a case where the print head 46 is an ink-jet type print head. However, the print head 46 is not limited to the ink-jet type, and for example, a pen such as a ballpoint pen and a felt pen may be used to directly touch the nail T and perform drawing. FIG. 15A schematically shows an example of an apparatus main body 10*b* of a nail print apparatus in such case.

In this case, as shown in FIG. 15A, a printing unit 40*b* includes a print head 46*b* which includes a plurality of drawing pens 41 of different colors and a movement mechanism 47 for moving the print head 46*b* in the X direction and the Y direction. Then, similarly to the above embodiments, a photographing unit 50 which has a photographing device 51 and a lighting device 52 is fixed on a side of the print head 46*b*.

Figure 15B:
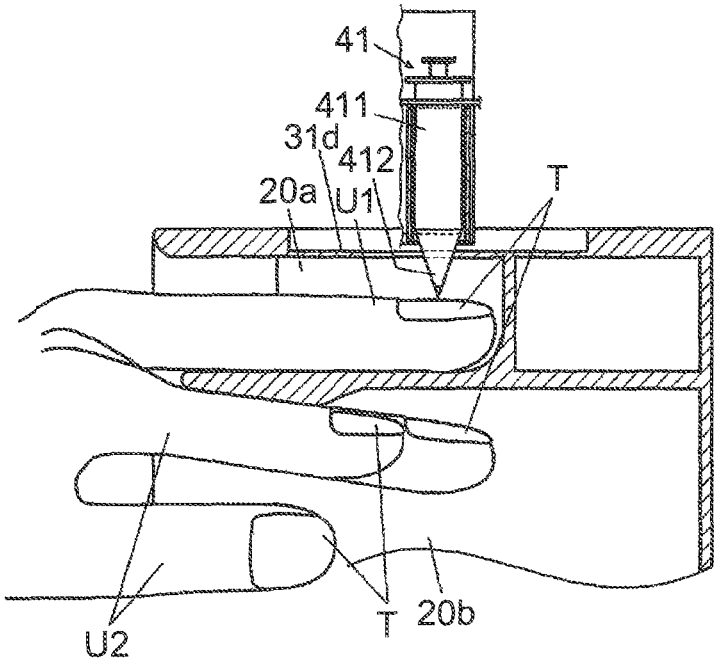
FIG. 15B is a sectional view of the apparatus main body in FIG. 15A along the line XV-XV.

As shown in FIG. 15B, a pen tip 412 of each of the pens 41 is provided at the distal end of a pen holder portion 411 thereof. When printing is performed, the pen tip 412 is controlled in height so as to touch the nail T. Then, the movement mechanism 47 moves a drawing head 42*b* on the basis of the printing data and thereby the pen 41 moves to draw an image on the nail T. In such case, similarly to the above embodiments, the photographing unit 50 can move back and forth and around by the movement mechanism 47 and the same effect as the embodiments can be obtained.

Though several embodiments have been described above, the scope of the invention is not limited to the above embodiments, and includes the scope of inventions, which is described in the scope of claims, and the scope equivalent thereof.

The entire disclosure of Japanese Patent Application No. 2012-190904 filed on Aug. 31, 2012 including description, claims, drawings, and abstract are incorporated herein by reference in its entirety.

What is claimed is:

1. A nail print apparatus, comprising:

a print head which performs printing on a nail region based on image data including a first design and a second design that is a background of the first design; and an image data processing unit which includes a second image data processing unit that processes the image data so that the second design covers an entire nail region, wherein the second design has an edge region which is provided inward from an end of a region of the second design, the edge region having a predetermined repeat width, and the second image data processing unit adds at least one edge region to the end of the region of the second design so that the second design covers the entire nail region.

2. The nail print apparatus according to claim 1, wherein the image data processing unit further includes a first image data processing unit that processes the image data so that the first design is included in the nail region.

3. The nail print apparatus according to claim 2, wherein:

the image data includes first image data which is image data of the first design and second image data which is image data of the second design, the first image data processing unit processes the first image data which is the image data of the first design so that the entire first design is included in the nail region, and the second image data processing unit processes the second image data which is the image data of the second design so that the second design covers the entire nail region.

4. The nail print apparatus according to claim 1, further comprising:

a photographing unit which photographs a finger to obtain a finger image;

a nail region extraction unit which extracts the nail region from the finger image obtained by the photographing unit; and a print control unit which controls the print head so as to perform the printing on the nail region based on the image data processed by the image data processing unit, wherein the first design includes at least one of a picture, a kanji character, a hiragana, a katakana, an alphabet character, a number, a symbol and a pictogram.

5. The nail print apparatus according to claim 1, further comprising an associating storage unit which stores the repeat width and the second design so as to be associated with each other, wherein the second image data processing unit processes the image data by repeatedly adding the edge region of the repeat width to the end of the region of the second design, the repeat width being stored in the associating storage unit.

6. The nail print apparatus according to claim 1, further comprising a display unit which displays the image data processed by the image data processing unit.

7. A print control method of a nail print apparatus which comprises a print head which performs printing on a nail region based on image data including a first design and a second design that is a background of the first design, and an image data processing unit which includes a second image data processing unit, wherein the second design has an edge region which is provided inward from an end of a region of the second design, the edge region having a predetermined repeat width, the method comprising:

processing the image data with the image data processing unit by adding, with the second image data processing unit, at least one edge region to the end of the region of the second design so that the second design covers an entire nail region in a case where printing is performed on the nail region by the print head.

8. The print control method of the nail print apparatus, according to claim 7, wherein the image data processing unit further includes a first image data processing unit, and the method further comprises processing the image data with the first image data processing unit so that the entire first design is included in the nail region.

9. The print control method of the nail print apparatus, according to claim 8, wherein:

the image data includes first image data which is image data of the first design and second image data which is image data of the second design, and the method comprises:

processing, with the first image data processing unit, the first image data which is the image data of the first design so that the entire first design is included in the nail region, and processing, with the second image data processing unit, the second image data which is the image data of the second design so that the second design covers the entire nail region.

10. The print control method of the nail print apparatus, according to claim 7, further comprising:

photographing a finger to obtain a finger image;

extracting the nail region from the finger image; and controlling the print head so as to perform the printing on the nail region based on the image data processed by the image data processing unit, wherein the first design includes at least one of a picture, a kanji character, a hiragana, a katakana, an alphabet character, a number, a symbol and a pictogram.

11. The print control method of the nail print apparatus, according to claim 7, further comprising storing the repeat width and the second design so as to be associated with each other, wherein the method comprises processing, with the second image data processing unit, the image data by repeatedly adding the edge region of the repeat width to the end of the region of the second design the repeat width being stored.

12. The print control method of the nail print apparatus, according to claim 7, further comprising displaying, on a display unit, the image data processed by the image data processing unit.

* * * * *